US012241275B2

(12) United States Patent
Yu et al.

(10) Patent No.: US 12,241,275 B2
(45) Date of Patent: Mar. 4, 2025

(54) SEISMICALLY SUSPENDED ISOLATION DEVICE WITH DISPLACEMENT SUPPRESSING MECHANISM

(71) Applicant: National Applied Research Laboratories, Taipei (TW)

(72) Inventors: Chung-Han Yu, Taipei (TW); Shiang-Jung Wang, Taipei (TW); Kuo-Chun Chang, Taipei (TW); Jenn-Shin Hwang, Taipei (TW)

(73) Assignee: NATIONAL APPLIED RESEARCH LABORATORIES, Taipei (TW)

( * ) Notice: Subject to any disclaimer, the term of this patent is extended or adjusted under 35 U.S.C. 154(b) by 0 days.

(21) Appl. No.: 18/518,707

(22) Filed: Nov. 24, 2023

(65) Prior Publication Data

US 2025/0019989 A1 Jan. 16, 2025

(30) Foreign Application Priority Data

Jul. 11, 2023 (TW) ..... 112125912

(51) Int. Cl.
*E04H 9/02* (2006.01)

(52) U.S. Cl.
CPC ..... *E04H 9/023* (2013.01)

(58) Field of Classification Search
CPC E04H 9/023; E04H 9/021; E04H 9/02; E04H 9/00; E04B 1/98; F16F 15/129; F16F 15/12; F16F 15/10
USPC ..... 248/638; 52/167.1
See application file for complete search history.

(56) References Cited

U.S. PATENT DOCUMENTS

2003/0196501 A1 10/2003 Doornbos et al.

FOREIGN PATENT DOCUMENTS

TW 200732541 A 9/2007

*Primary Examiner* — Eret C McNichols
*Assistant Examiner* — Michael McDuffie
(74) *Attorney, Agent, or Firm* — MUNCY, GEISSLER, OLDS & LOWE, P.C.

(57) ABSTRACT

A seismically suspended isolation device is installed in a suspended configuration at a fixed end and comprises a first support module, a second support module, a first displacement suppressing module and a second displacement suppressing module. The first support module includes a first fixing element, a first moving element, and at least one first roller. The first roller is disposed between the first fixing element and the first moving element. The second support module includes a second fixing element, a second moving element, and at least one second roller. The second roller is disposed between the second fixing element and the second moving element. The first support module and the second support module are stacked together in an orthogonal manner, so that the seismically suspended isolation device generates motion in the first direction and the second direction when the seismically suspended isolation device subjected to an external force.

10 Claims, 8 Drawing Sheets

SEISMICALLY SUSPENDED ISOLATION DEVICE WITH DISPLACEMENT SUPPRESSING MECHANISM

CROSS REFERENCE TO RELATED APPLICATION

This application claims the benefits of the Taiwan Patent Application Serial Number 112125912, filed on Jul. 11, 2023, the subject matter of which is incorporated herein by reference.

BACKGROUND OF THE INVENTION

1. Field of the Invention

The present invention relates to a seismically suspended isolation device with displacement suppressing mechanism, particularly to a seismically suspended isolation device composed of seismically suspended isolation elements capable of bearing tension.

2. Description of Related Art

In regions frequently experiencing earthquakes, equipment, instruments, cabinets, and stored items in buildings are susceptible to damage due to the impact of seismic vibrations. As a result, the seismic isolation technology is employed in structural engineering. Its main function is to reduce the transmission of energy from earthquakes or other vibrations to the structure or the protected object, thereby protecting the structure or the object from damage caused by excessive vibration energy.

Currently, the seismic isolation technology available on the market often utilizes sloped or sliding seismic isolation. It reduces the impact of vibrations on the protected object through the rolling or sliding mechanisms of components within the isolation structure, along with the additional use of the energy dissipation mechanisms such as fluid dampers, friction dampers, or lateral friction plates. However, the current application of the aforementioned seismic isolation technology is to install at the bottom of the object structure, and the seismic isolation device is capable of gravity load. When an earthquake occurs, it can isolate the seismic energy, significantly mitigating the extent of vibration transmission to the protected object, reducing the acceleration and displacement of the protected object, and reducing the damage to the protected object caused by earthquake. Nevertheless, since the existing seismic isolation is only limited to moving in accordance with the design of bearing type, effective seismic isolation measures cannot be provided for equipment installed on the ceiling or suspended transportation systems.

In view of the above, the present invention provides a seismically suspended isolation device with displacement suppressing mechanism to solve the problem in the prior art that it cannot be effectively used for vibration isolation in suspended equipment or suspended transportation system.

SUMMARY OF THE INVENTION

An objective of the present invention is to provide a seismically suspended isolation device with displacement suppressing mechanism and a seismically suspended isolation system with displacement suppressing mechanism. The seismically suspended isolation device with displacement suppressing mechanism comprises two horizontal one-way tension type support modules, and the assembly of fixing element and moving element in the support modules enables the support modules to exhibit the self-centering capability after being disturbed. Among them, the support modules further comprise displacement suppressing modules capable of reducing the displacement caused by earthquakes and lowering the space requirement for seismic isolation.

In addition, the seismically suspended isolation system with displacement suppressing mechanism is composed of a plurality of the seismically suspended isolation device with displacement suppressing mechanism connected in parallel. The seismically suspended isolation system is capable of systematically isolating large suspended equipment or the protected objects with irregular shapes. Therefore, the seismically suspended isolation device with displacement suppressing mechanism and the seismically suspended isolation system with displacement suppressing mechanism can provide seismic protection for suspended objects. Furthermore, the structures that internally install the seismically suspended isolation device with displacement suppressing mechanism or the seismically suspended isolation system with displacement suppressing mechanism have the function of tuned mass, reducing the seismic response of the structure during earthquakes.

To achieve the above object, the present invention provides a seismically suspended isolation device with displacement suppressing mechanism is used for hanging an object. The seismically suspended isolation device with displacement suppressing mechanism comprises a first support module, a second support module, a first displacement suppressing module and a second displacement suppressing module. The first support module includes a first fixing element, a first moving element and a plurality of first rollers. The first fixing element has at least one pair of first extension arms. The first moving element has at least one pair of second extension arms. The first extension arms are staggered with the second extension arms. The first rollers are disposed between the first fixing element and the first moving element, capable of rolling along a first direction and allowing the first moving element to move relative to the first fixing element in the first direction. The second support module includes a second fixing element, a second moving element and a plurality of second rollers. The second fixing element has at least one pair of third extension arms. The second moving element has at least one pair of fourth extension arms. The third extension arms are staggered with the fourth extension arms. The second rollers are disposed between the second fixing element and the second moving element, capable of rolling along a second direction and allowing the second moving element to move relative to the second fixing element in the second direction. The first displacement suppressing module is connected to the first fixing element and the first moving element, providing the displacement suppression force to the first moving element along the first direction. The second displacement suppressing module is connected to the second fixing element and the second moving element, providing the displacement suppression force to the second moving element along the second direction. The first support module and the second support module are stacked together in an orthogonal manner. The first moving element is connected to the second fixing element and the second moving element is connected to the object, so that the seismically suspended isolation device with displacement suppressing mechanism absorbs an external force in both the first direction and the second direction when subjected to the external force.

In one embodiment, the first fixing element further comprises at least one first cross arm connected to the first extension arm. The first moving element further comprises at least one second cross arm connected to the second extension arm. At least one of the inner side of the first cross arm and the second cross arm is non-planar. The first rollers move along the first direction between the first cross arm and the second cross arm when the first moving element moves relative to the first fixing element.

In one embodiment, the first roller further has a first gear. The first cross arm further has a first upper gear rack, and the second cross arm further has a first lower gear rack. The first gear engages with both the first upper gear rack and the first lower gear rack.

In one embodiment, the second fixing element further comprises at least one third cross arm connected to the third extension arm. The second moving element further comprises at least one fourth cross arm connected to the fourth extension arm. At least one of the inner side of the third cross arm and the fourth cross arm is non-planar. The second rollers move along the second direction between the third cross arm and the fourth cross arm when the second moving element moves relative to the second fixing element.

In one embodiment, the second roller further has a second gear. The third cross arm further has a second upper gear rack, and the fourth cross arm further has a second lower gear rack. The second gear engages with both the second upper gear rack and the second lower gear rack.

In one embodiment, the first displacement suppressing module and the second displacement suppressing module are friction damper, fluid viscous damper, or flywheel inerter.

In one embodiment, the first displacement suppressing module and the second displacement suppressing module are respectively flywheel inerter. The first displacement suppressing module includes a first body, a first moving gear and a first vertical bearing. The second displacement suppressing module includes a second body, a second moving gear and a second vertical bearing. The first vertical bearing is disposed through the first body and the first moving gear, and is fixed on the first moving element. The second vertical bearing is disposed through the second body and the second moving gear, and is fixed on the second moving element.

In one embodiment, the first cross arm further comprises a first guide rack formed on the outer side of the first cross arm. The third cross arm further comprises a second guide rack formed on the outer side of the third cross arm. The first moving gear engages with the first guide rack. The second moving gear engages with the second guide rack. The first moving gear and the second moving gear are capable of moving along the first guide rack and the second guide rack when the seismically suspended isolation device with displacement suppressing mechanism is subjected to the external force.

In one embodiment, the first fixing element further comprises at least one first side plate. The second fixing element further comprises at least one second side plate. The first side plates restrict the first roller to roll along the first direction, and the second side plates restrict the second roller to roll along the second direction.

The present invention further provides a seismically suspended isolation system with displacement suppressing mechanism. The seismically suspended isolation system with displacement suppressing mechanism comprises a plurality of the seismically suspended isolation device with displacement suppressing mechanism in accordance with the invention, connected in parallel to each other.

DETAILED DESCRIPTION OF THE PREFERRED EMBODIMENT

Figure 1:
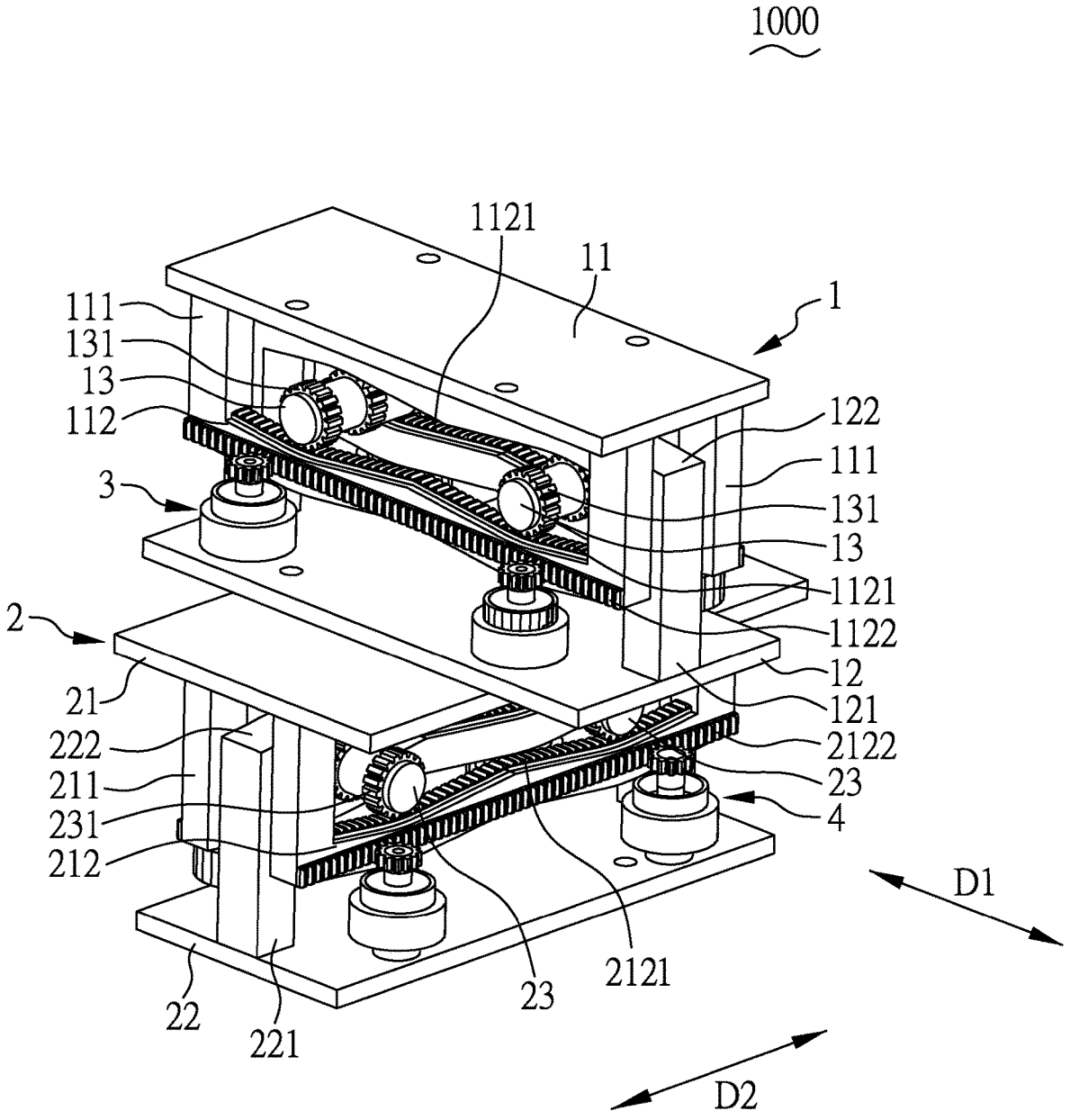
FIG. 1 is a schematic view of the seismically suspended isolation device with displacement suppressing mechanism of one embodiment of the present invention.

Reference will now be made in detail to the present embodiments of the invention, examples of which are illustrated in the accompanying drawings, and are not intended to limit the present invention, applications, or implementations described in these embodiments. Wherever possible, the same reference numbers are used in the drawings and the description to refer to the same or like parts. It shall be appreciated that, in the following embodiments and the attached drawings, elements unrelated to the present invention are omitted from depiction; and dimensional relationships among individual elements in the attached drawings are provided only for ease of understanding, but not to limit the actual scale.

Figure 2:
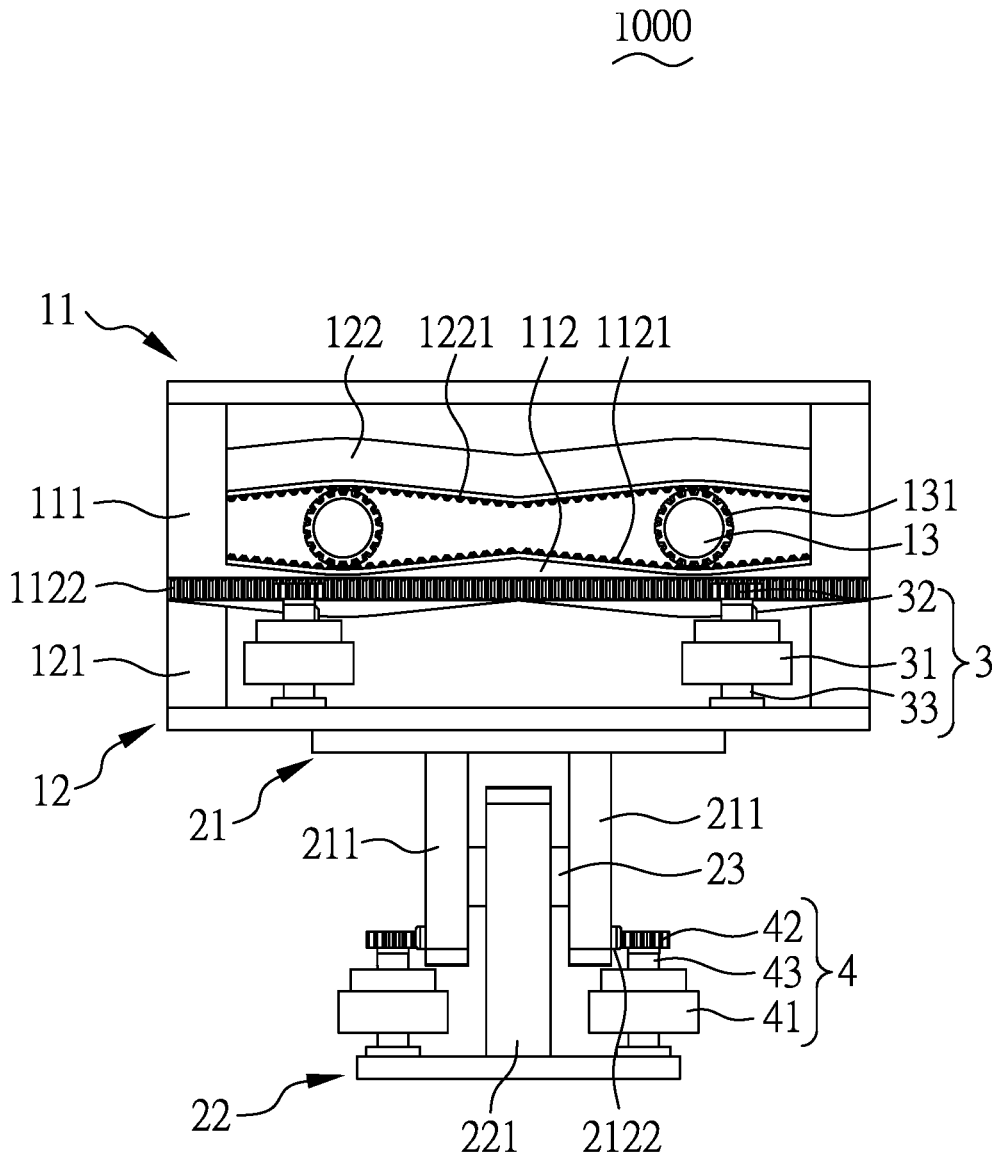
FIG. 2 is a side view of the seismically suspended isolation device with displacement suppressing mechanism of one embodiment of the present invention.
Figure 8:
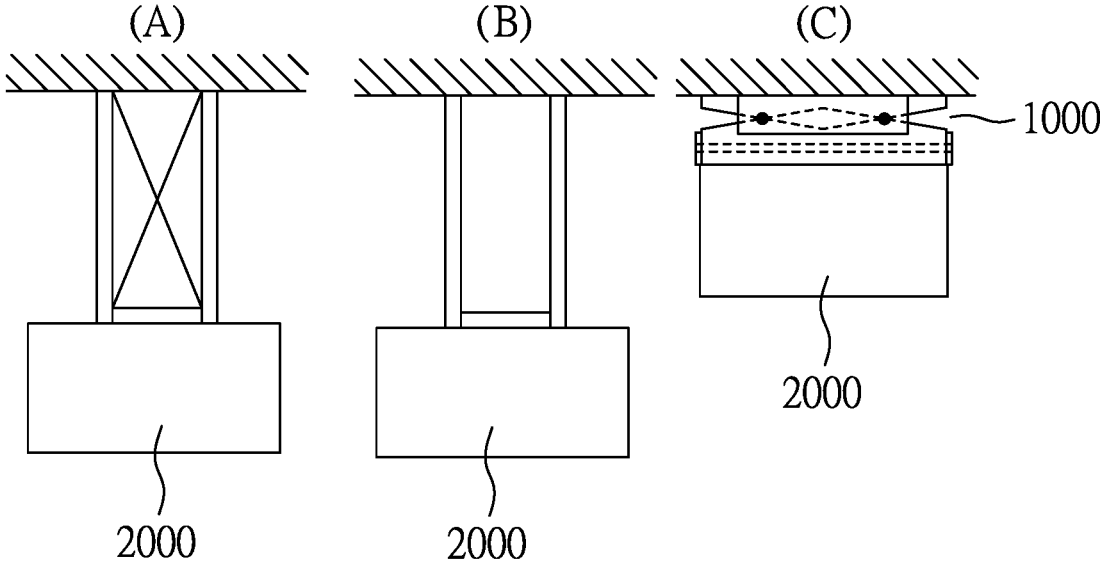
FIG. 8 is a simulated view of the seismically suspended isolation device with displacement suppressing mechanism compared to the prior art of one embodiment of the present invention.

Please refer to FIG. 1, FIG. 2 and FIG. 8. FIGS. 1 and 2 show a schematic view and a side view of a seismically suspended isolation device with displacement suppressing mechanism 1000 according to one embodiment of the present invention. FIG. 8 is a simulated view of the seismically suspended isolation device with displacement suppressing mechanism 1000 compared to the prior art of one embodiment of the present invention. The seismically suspended isolation device with displacement suppressing mechanism 1000 is used for hanging an object 2000 and includes a first support module 1, a second support module 2, a first displacement suppressing module 3, and a second displacement suppressing module 4. The first support module 1 and the second support module 2 are stacked together in an orthogonal manner. The first support module 1 is able to be connected to the structure of the ceiling or the roof. The second support module 2 is connected to the object 2000 to be hung. The first displacement suppressing module 3 is disposed on the first support module 1, and the second displacement suppressing module 4 is disposed on the second support module 2. The first displacement suppressing module 3 and the second displacement suppressing module 4 can respectively provide the first support module 1 and the second support module 2 with the capability to absorb vibrations and reduce displacement. Furthermore, as shown in FIG. 8, A and B respectively represent reinforcing and general suspension techniques used in conventional suspension systems for hanging the objects. C represents the seismically suspended isolation technology with displacement suppressing mechanism of the present invention, and is installed in a suspended manner at either of the upper fixed ends. The distinctions between the present invention and the prior art are clearly identifiable from the figure.

Figure 3:
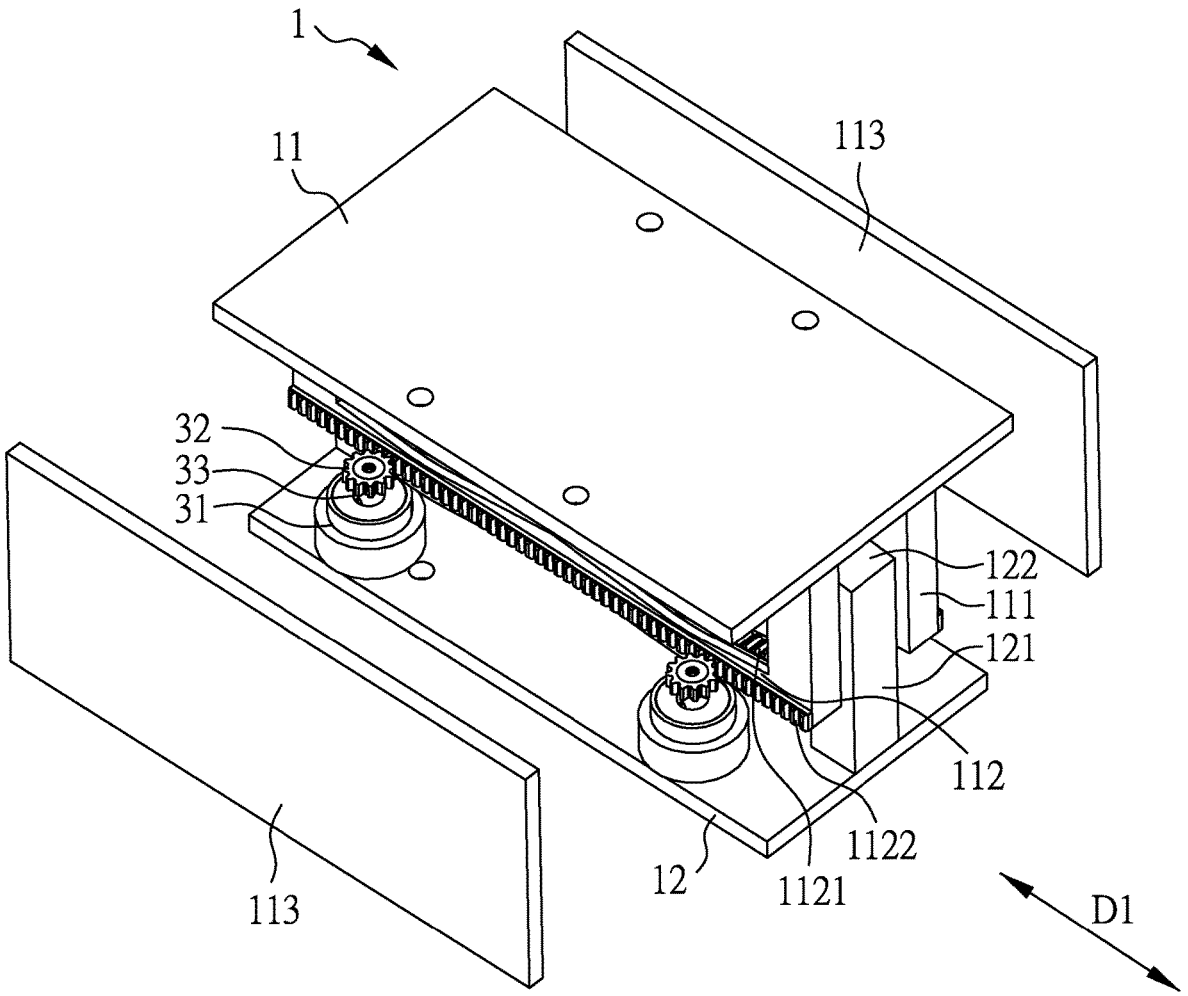
FIG. 3 is a partial schematic view of the seismically suspended isolation device with displacement suppressing mechanism of one embodiment of the present invention.

Reference is next made to FIG. 3 for illustrating the first support module 1, which depicts a partial schematic view of the seismically suspended isolation device with displacement suppressing mechanism 1000. The first support module 1 includes a first fixing element 11, a first moving element 12, and two first rollers 13. The first fixing element 11 engages with the first moving element 12. The first rollers 13 are disposed between the first fixing element 11 and the first moving element 12. When the first moving element 12 moves relative to the first fixing element 11 in a first direction D1, the first roller 13 can be driven to roll along the first direction D1. The first fixing element 11 includes four first extension arms 111, two first cross arms 112, and two first side plates 113. The first extension arms 111 are disposed at both ends of the first fixing element 11 in the direction of the device movement, and each pair of the first extension arms 111 is connected to each other through the first cross arm 112. One of the first cross arms 112 is connected between the two first extension arms 111 located on the same side. The first side plates 113 are able to be connected to the left and right sides of the first rollers 13 sandwiched by the first fixing element 11 to provide lateral protection, limiting the first rollers 13 from rolling in the first direction D1 and preventing the first rollers 13 from falling off. In addition, the first cross arm 112 further comprises a first upper gear rack 1121 and a first guide rack 1122. The first upper gear rack 1121 is formed on the inner side (upper surface) of the first cross arm 112. The first guide rack 1122 is formed on the outer side of the first cross arm 112.

Please refer back to FIGS. 1-3, the first moving element 12 includes two second extension arms 121, and one second cross arm 122. The second extension arms 121 are disposed at both ends of the first moving element 12 in the direction of the device movement. The second cross arm 122 is connected between the two second extension arms 121, and each pair of the second extension arms 121 is connected to each other through the second cross arm 122. In detail, the first extension arms 111 and the first cross arms 112 of the first fixing element 11 are staggered with the second extension arms 121 and the second cross arm 122 of the first moving element 12, as shown in FIG. 1. The second extension arm 121 is disposed between the two first extension arms 111. The second cross arm 122 further comprises a first lower gear rack 1221, which is formed on the inner side (lower surface) of the second cross arm 122. At least one of the vertically inner sides (upper surface) of the first cross arms 112 and the vertically inner side (lower surface) of the second cross arm 122 is non-planar. The first rollers 13 is disposed between the first cross arms 112 of the first fixing element 11 and the second cross arm 122 of the first moving element 12. When the first moving element 12 moves relative to the first fixing element 11, the first rollers 13 move along the first direction D1 between the first cross arms 112 and the second cross arm 122. For example, in the embodiment, both the inner sides (upper surface) of the first cross arm 112 and the inner side (lower surface) of the second cross arm 122 are non-planar. The non-planar side can be a curved surface, a V-shaped inclined surface, or a surface designed using any mathematical functions. The main purpose of the non-planar design is to enable the first rollers 13 to roll, thereby providing them with the self-centering capability after vibrations. Therefore, separately design the inner side (upper surface) of the first cross arms 112 to be non-planar or separately design the inner side (lower surface) of the second cross arm 122 to be non-planar both enable the first rollers 13 to possess the self-centering capability, and is not limited thereto.

Furthermore, as shown in FIG. 1, in this embodiment, each of the first rollers 13 further includes three first gears 131. The first gears 131 are disposed on the first roller 13 to respectively correspond to the positions of the two first upper gear racks 1121 and the first lower gear rack 1221, enabling each of the first gears 131 to engage with its corresponding the first upper gear racks 1121 and the first lower gear rack 1221. When seismically suspended isolation device with displacement suppressing mechanism 1000 is subjected to the external force, the first rollers 13 are capable of rolling on the first upper gear racks 1121 and the first lower gear rack 1221 through the first gears 131. The engagement between the gears and the gear racks also serves to limit the position of the first rollers 13. The number of the first gears 131 can be adjusted according to practical requirements to correspond to the number of the first upper gear racks 1121 and the first lower gear rack 1221, and is not limited thereto.

It should be noted that the first cross arms 112 of the first fixing element 11 and the second cross arm 122 of the first moving element 12 are staggered up and down for the purpose of sandwiching the first rollers 13. Another purpose is to limit the position of the first rollers 13 so that they can roll stably therein. Therefore, in this embodiment, when the number of the first cross arm 112 is 1, the number of the second cross arm 122 is greater than 1. Conversely, when the number of the second cross arm 122 is 1, the number of the first cross arm 112 can be greater than 1, or both the numbers of the first cross arm 112 and the second cross arm 122 are greater than 1 at the same time. The number can be adjusted according to actual requirements, and is not limited thereto.

Figure 5:
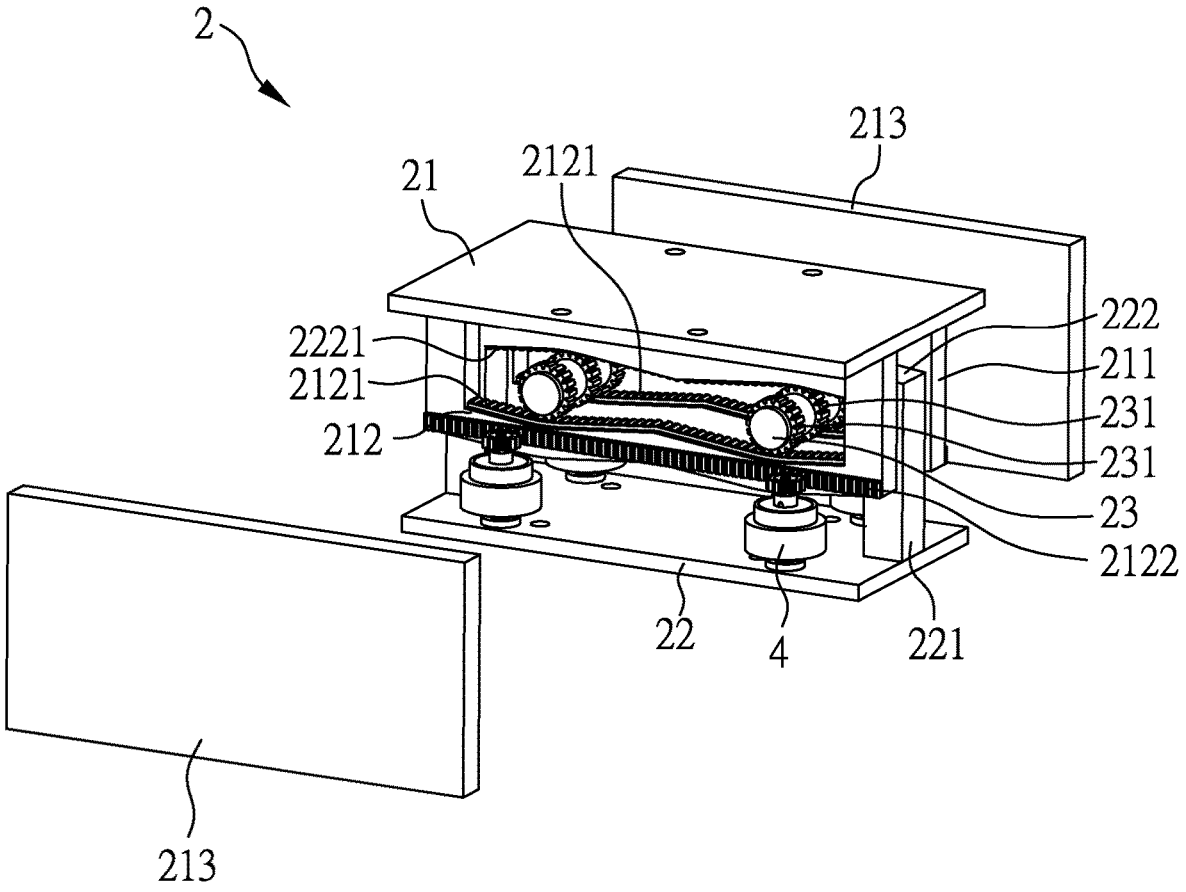
FIG. 5 is a partial schematic view of the seismically suspended isolation device with displacement suppressing mechanism of one embodiment of the present invention.

Please refer to FIG. 1 and FIG. 5 to illustrate the second support module 2. The second support module 2 includes a second fixing element 21, a second moving element 22, and two second rollers 23. The second fixing element 21 engages with the second moving element 22. The second rollers 23 are disposed between the second fixing element 21 and the second moving element 22. When the second moving element 22 moves relative to the second fixing element 21 in a second direction D2, the second roller 23 can be driven to roll along the second direction D2. The second fixing element 21 includes four third extension arms 211, two third cross arms 212, and two second side plates 213. The third extension arms 211 are disposed at both ends of the second fixing element 21 in the direction of the device movement, and each pair of the third extension arms 211 is connected to each other through the third cross arm 212. One of the third cross arms 212 is connected between the two third extension arms 211 located on the same side. The second side plates 213 are able to be connected to the left and right sides of the second rollers 23 sandwiched by the second fixing element 21 to provide lateral protection, limiting the second rollers 23 from rolling in the second direction D2 and preventing the second rollers 23 from falling off. In addition, the third cross arm 212 further comprises a second upper gear rack 2121 and a second guide rack 2122. The second upper gear rack 2121 is formed on the inner side (upper surface) of the third cross arm 212. The second guide rack 2122 is formed on the outer side of the third cross arm 212.

Precisely, the second moving element 22 includes two fourth extension arms 221, and one fourth cross arm 222. The fourth extension arms 221 are disposed at both ends of the second moving element 22 in the direction of the device movement. The fourth cross arm 222 is connected between the two fourth extension arms 221, and each pair of the fourth extension arms 221 is connected to each other through the fourth cross arm 222. More precisely, the third extension arms 211 and the third cross arms 212 of the second fixing element 21 are staggered with the fourth extension arms 221 and the fourth cross arm 222 of the second moving element 22, as shown in FIG. 1. The fourth extension arm 221 is disposed between the two third extension arms 211. The fourth cross arm 222 further comprises a second lower gear rack 2221, which is formed on the inner side (lower surface) of the fourth cross arm 222. At least one of the vertically inner sides (upper surface) of the third cross arms 212 and the vertically inner side (lower surface) of the fourth cross arm 222 is non-planar. The second rollers 23 is disposed between the third cross arms 212 of the second fixing element 21 and the fourth cross arm 222 of the second moving element 22. When the second moving element 22 moves relative to the second fixing element 21, the second rollers 23 move along the second direction D2 between the third cross arms 212 and the fourth cross arm 222. For example, in the embodiment, both the inner sides (upper surface) of the third cross arm 212 and the inner side (lower surface) of the fourth cross arm 222 are non-planar. The non-planar side can be a curved surface, a V-shaped inclined surface, or a surface designed using any mathematical functions. The main purpose of the non-planar design is to enable the second rollers 23 to roll, thereby providing them with the self-centering capability after vibrations. Therefore, separately design the inner side (upper surface) of the third cross arms 212 to be non-planar or separately design the inner side (lower surface) of the fourth cross arm 222 to be non-planar both enable the second rollers 23 to possess the self-centering capability, and is not limited thereto.

Figure 4:
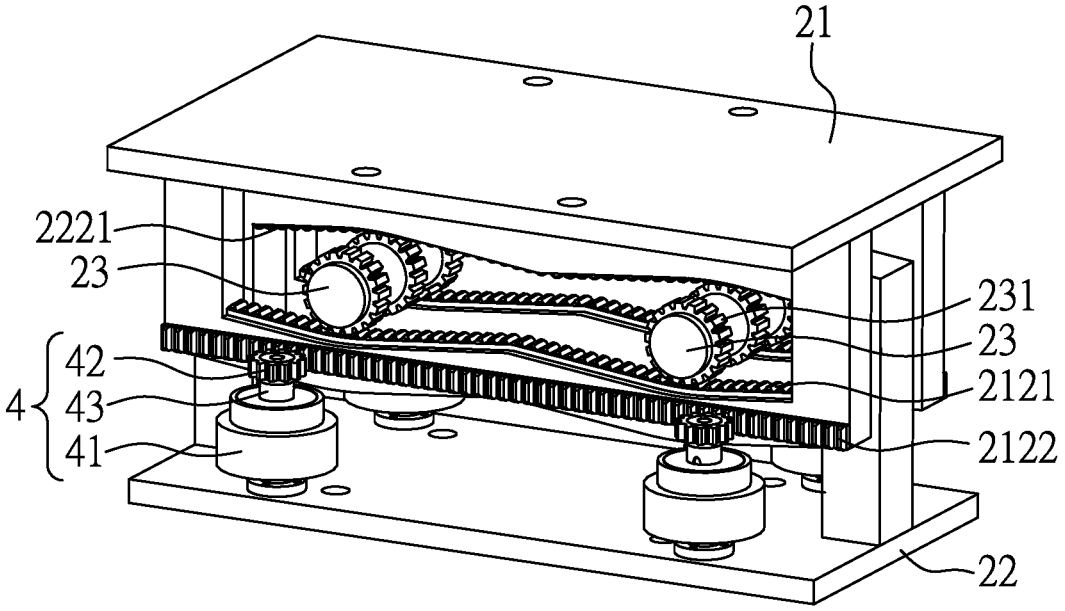
FIG. 4 is a partial schematic view of the seismically suspended isolation device with displacement suppressing mechanism of one embodiment of the present invention.

Please further refer to FIG. 4, in this embodiment, each of the second rollers 23 further includes three second gears 231. The second gears 231 are disposed on the second roller 23 to respectively correspond to the positions of the two second upper gear racks 2121 and the second lower gear rack 2221, enabling each of the second gears 231 to engage with its corresponding the second upper gear racks 2121 and the second lower gear rack 2221. When seismically suspended isolation device with displacement suppressing mechanism 1000 is subjected to the external force, the second rollers 23 are capable of rolling on the second upper gear racks 2121 and the second lower gear rack 2221 through the second gears 231. The engagement between the gears and the gear racks also serves to limit the position of the second rollers 23. The number of the second gears 231 can be adjusted according to practical requirements to correspond to the number of the second upper gear racks 2121 and the second lower gear rack 2221, and is not limited thereto.

It should be noted that the third cross arms 212 of the second fixing element 21 and the fourth cross arm 222 of the second moving element 22 are staggered up and down for the purpose of sandwiching the second rollers 23. Another purpose is to limit the position of the second rollers 23 so that they can roll stably therein. Therefore, in this embodiment, when the number of the third cross arm 212 is 1, the number of the fourth cross arm 222 is greater than 1. Conversely, when the number of the fourth cross arm 222 is 1, the number of the third cross arm 212 can be greater than 1, or both the numbers of the third cross arm 212 and the fourth cross arm 222 are greater than 1 at the same time. The number can be adjusted according to actual requirements, and is not limited thereto.

In this embodiment, the seismically suspended isolation device with displacement suppressing mechanism 1000 of the present invention is vertically stacked by the first support module 1 and the second support module 2, with the first support module 1 is arranged along the first direction D1, and the second support module 2 is arranged along the second direction D2, which are the orthogonal directions. Thereafter, the first moving element 12 connects to the second fixing element 21, and the second moving element 22 connects to the object 2000, allowing the seismically suspended isolation device with displacement suppressing mechanism 1000 to absorb the external force in both the first direction D1 and the second direction D2 when subjected to it. In other words, it can provide seismic isolation effects in all horizontal directions. Within this context, the first direction D1 is perpendicular to the second direction D2.

The first displacement suppressing module 3 and the second displacement suppressing module 4 are described as follows. The first displacement suppressing module 3 connects to the first fixing element 11 and the first moving element 12, providing the displacement suppression force to the first moving element 12 along the first direction D1. The first displacement suppressing module 3 includes a first body 31, a first moving gear 32 and a first vertical bearing 33. The first vertical bearing 33 is inserted through the first body 31 and the first moving gear 32, and fixed on the first moving element 12. The first moving gear 32 aligns with the outer side of the first cross arm 112 and engages with the first guide rack 1122. Furthermore, the second displacement suppressing module 4 connects to the second fixing element 21 and the second moving element 22, providing displacement suppression force to the second moving element 22 along the second direction D2. The second displacement suppressing module 4 includes a second body 41, a second moving gear 42, and a second vertical bearing 43. The second vertical bearing 43 is inserted through the second body 41 and the second moving gear 42, and fixed on the second moving element 22. The second moving gear 42 aligns with the outer side of the third cross arm 212 and engages with the second guide rack 2122.

It should be noted that the first displacement suppressing module 3 and the second displacement suppressing module 4 can be friction damper, fluid viscous damper, or flywheel inerter. In this embodiment, the first displacement suppressing module and the second displacement suppressing module are respectively flywheel inerter. When the seismically suspended isolation device with displacement suppressing mechanism 1000 is subjected to the external force and vibrates, the first support module 1 and the second support module 2 laterally displace due to the external force. The first moving gear 32 and the second moving gear 42 are capable of moving on the first guide rack 1122 and the second guide rack 2122 respectively. The inertia mass generated by the rotation of the flywheel can reduce the transmitted vibrations. However, considering the overall structural stability and the the effect of reducing vibration, the aforementioned first displacement suppressing module 3 and the second displacement suppressing module 4 each use four as an example. The number and the type can be adjusted according to actual requirements, and is not limited thereto.

Figure 6:
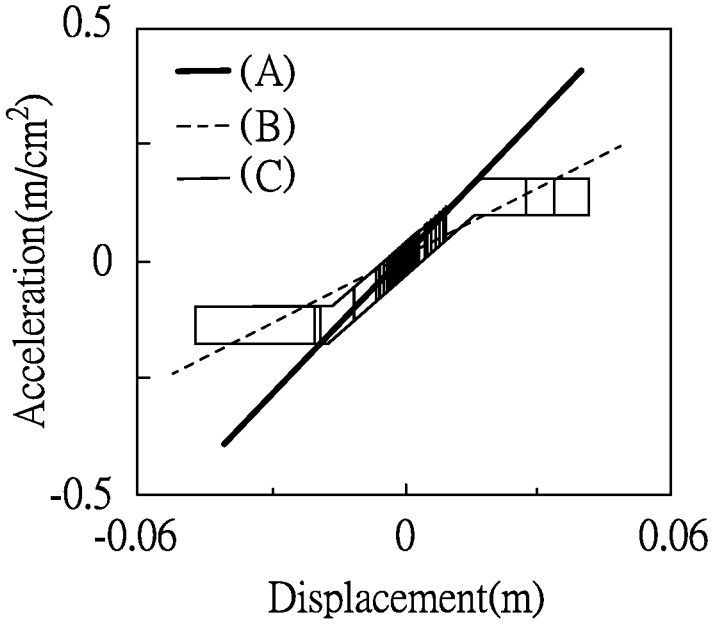
FIG. 6 depicts the displacement and acceleration comparison between the seismically suspended isolation device with displacement suppressing mechanism and the prior art of one embodiment of the present invention.
Figure 7:
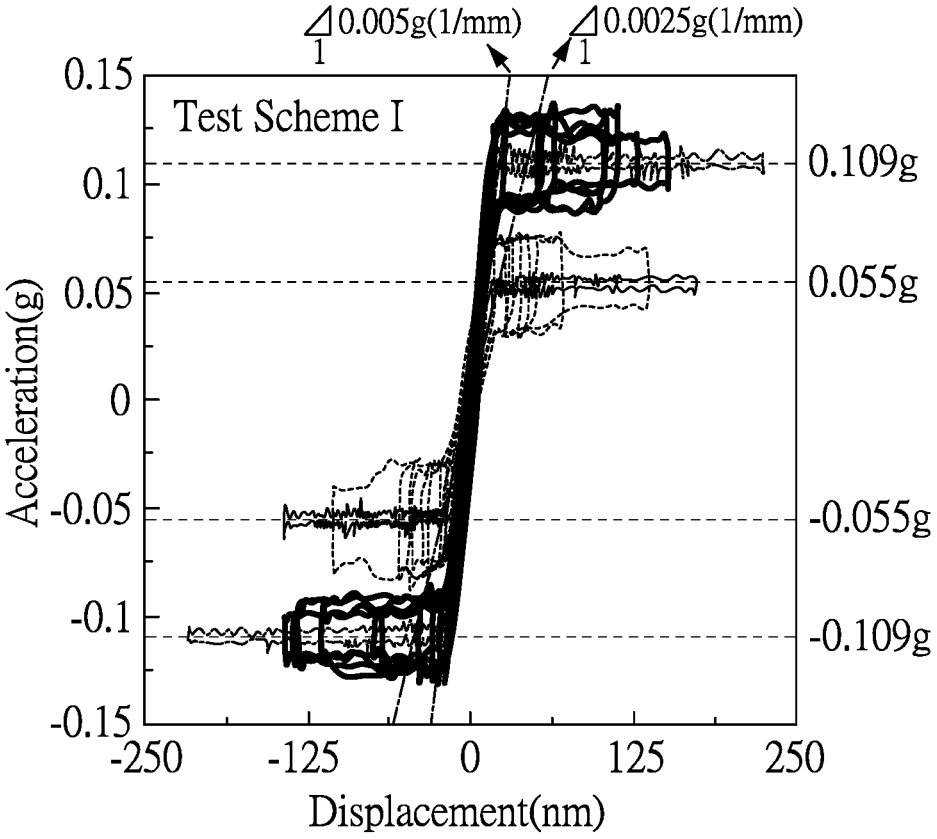
FIG. 7 depicts the displacement and acceleration of the seismically suspended isolation device with displacement suppressing mechanism of one embodiment of the present invention.

Please refer to FIG. 6 to FIG. 8. FIG. 6 and FIG. 7 depict the displacement and acceleration of the seismically suspended isolation device with displacement suppressing mechanism 1000 in one embodiment of the present invention. Based on the figures, it can be seen that under different dimensions of shaking or vibration, the seismically suspended isolation device with displacement suppressing mechanism 1000 of the present invention (C) is capable of maintaining a consistent level of acceleration under the same displacement, as compared to reinforcing (A) and general (B) suspension techniques used in conventional suspension systems. This effectively limits more vibrations from being transmitted to the seismically suspended isolation device with displacement suppressing mechanism 1000 of the present invention, thereby proving that the present invention indeed offers a superior seismic isolation effect compared to the conventional anti-seismic suspension technology.

In this embodiment, a seismically suspended isolation system with displacement suppressing mechanism is also provided. The seismically suspended isolation system comprises the aforementioned plurality of the seismically suspended isolation device with displacement suppressing mechanism 1000, which are connected in parallel through connecting components. The seismically suspended isolation system assembled and connected in parallel can significantly increase the contact area with the object 2000. It can be used in large suspended equipment or suspended transportation systems to provide the systematic seismic isolation for the objects 2000 with heavy weight, large size, or irregular shape.

According to the above, the seismically suspended isolation device with displacement suppressing mechanism of the present invention comprises two support modules in the horizontal direction and a vertical direction, and the displacement suppressing modules connected to the support modules. This feature enables the seismically suspended isolation device with displacement suppressing mechanism to reduce and stabilize vibrations transmitted to the device when subjected to external forces, and has self-centering capability after vibration. This contributes to the seismically suspended isolation device with displacement suppressing mechanism exhibiting stable seismic isolation effect in a 360-degree space. In addition, the seismically suspended isolation system with displacement suppressing mechanism, which is composed of multiple seismically suspended isolation devices with displacement suppressing mechanism in parallel, is capable of providing seismic protection for large suspended equipment or suspended transportation systems.

Although the present invention has been described in considerable detail with reference to certain embodiments thereof, other embodiments are possible. Therefore, the spirit and scope of the appended claims should not be limited to the description of the embodiments contained herein.

What is claimed is:

1. A seismically suspended isolation device with displacement suppressing mechanism, being used for hanging an object, the seismically suspended isolation device with displacement suppressing mechanism comprising:

a first support module including a first fixing element, a first moving element and a plurality of first rollers, wherein the first fixing element having at least one pair of first extension arms, the first moving element having at least one pair of second extension arms, and the first extension arms being staggered with the second extension arms, wherein the first rollers being disposed between the first fixing element and the first moving element, capable of rolling along a first direction and allowing the first moving element to move relative to the first fixing element in the first direction;

a second support module including a second fixing element, a second moving element and a plurality of second rollers, wherein the second fixing element having at least one pair of third extension arms, the second moving element having at least one pair of fourth extension arms, and the third extension arms being staggered with the fourth extension arms, wherein the second rollers being disposed between the second fixing element and the second moving element, capable of rolling along a second direction and allowing the second moving element to move relative to the second fixing element in the second direction;

a first displacement suppressing module, being connected to the first fixing element and the first moving element, providing the displacement suppression force to the first moving element along the first direction; and a second displacement suppressing module, being connected to the second fixing element and the second moving element, providing the displacement suppression force to the second moving element along the second direction;

wherein the first support module and the second support module are stacked together in an orthogonal manner, the first moving element is connected to the second fixing element and the second moving element is connected to the object, so that the seismically suspended isolation device with displacement suppressing mechanism absorbs an external force in both the first direction and the second direction when subjected to the external force.

2. The seismically suspended isolation device with displacement suppressing mechanism of claim 1, wherein the first fixing element further comprises at least one first cross arm, being connected to the first extension arm, and the first moving element further comprises at least one second cross arm, being connected to the second extension arm, and at least one of the inner side of the first cross arm and the second cross arm is non-planar, wherein the first rollers move along the first direction between the first cross arm and the second cross arm when the first moving element moves relative to the first fixing element.

3. The seismically suspended isolation device with displacement suppressing mechanism of claim 2, wherein the first roller further has a first gear, the first cross arm further has a first upper gear rack, and the second cross arm further has a first lower gear rack, wherein the first gear engages with both the first upper gear rack and the first lower gear rack.

4. The seismically suspended isolation device with displacement suppressing mechanism of claim 2, wherein the second fixing element further comprises at least one third cross arm, being connected to the third extension arm, and the second moving element further comprises at least one fourth cross arm, being connected to the fourth extension arm, and at least one of the inner side of the third cross arm and the fourth cross arm is non-planar, wherein the second rollers move along the second direction between the third cross arm and the fourth cross arm when the second moving element moves relative to the second fixing element.

5. The seismically suspended isolation device with displacement suppressing mechanism of claim 4, wherein the second roller further has a second gear, the third cross arm further has a second upper gear rack, and the fourth cross arm further has a second lower gear rack, wherein the second gear engages with both the second upper gear rack and the second lower gear rack.

6. The seismically suspended isolation device with displacement suppressing mechanism of claim 1, wherein the first displacement suppressing module and the second displacement suppressing module are friction damper, fluid viscous damper, or flywheel inerter.

7. The seismically suspended isolation device with displacement suppressing mechanism of claim 6, wherein the first displacement suppressing module and the second displacement suppressing module are respectively flywheel inerter, wherein the first displacement suppressing module includes a first body, a first moving gear and a first vertical bearing, the second displacement suppressing module includes a second body, a second moving gear and a second vertical bearing, and the first vertical bearing is disposed through the first body and the first moving gear, and is fixed on the first moving element, and wherein the second vertical bearing is disposed through the second body and the second moving gear, and is fixed on the second moving element.

8. The seismically suspended isolation device with displacement suppressing mechanism of claim 7, wherein the first cross arm further comprises a first guide rack formed on the outer side of the first cross arm, the third cross arm further comprises a second guide rack formed on the outer side of the third cross arm, and the first moving gear engages with the first guide rack, the second moving gear engages with the second guide rack, and wherein the first moving gear and the second moving gear are capable of moving along the first guide rack and the second guide rack when the seismically suspended isolation device with displacement suppressing mechanism is subjected to the external force.

9. The seismically suspended isolation device with displacement suppressing mechanism of claim 1, wherein the first fixing element further comprises at least one first side plate, the second fixing element further comprises at least one second side plate, wherein the first side plates restrict the first roller to roll along the first direction, and the second side plates restrict the second roller to roll along the second direction.

10. A seismically suspended isolation system with displacement suppressing mechanism comprising a plurality of the seismically suspended isolation device with displacement suppressing mechanism of claim 1, connected in parallel to each other.

* * * * *